US011466410B2

(12) United States Patent
Yamazaki et al.

(10) Patent No.: US 11,466,410 B2
(45) Date of Patent: Oct. 11, 2022

(54) LID, METHOD OF PRODUCING LID, AND MOLDS FOR FORMING MOLDED PULP

(71) Applicant: TOPPAN INC., Tokyo (JP)

(72) Inventors: Michihisa Yamazaki, Tokyo (JP); Tomoko Mita, Tokyo (JP); Ryoichi Takita, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 0 days.

(21) Appl. No.: 17/523,163

(22) Filed: Nov. 10, 2021

(65) Prior Publication Data

US 2022/0064869 A1 Mar. 3, 2022

Related U.S. Application Data

(63) Continuation of application No. PCT/JP2020/018666, filed on May 8, 2020.

(30) Foreign Application Priority Data

May 16, 2019 (JP) ..... JP2019-092963

(51) Int. Cl.
*D21J 3/00* (2006.01)
*B65D 43/02* (2006.01)

(52) U.S. Cl.
CPC ..... *D21J 3/00* (2013.01); *B65D 43/0222* (2013.01); *B65D 2543/00092* (2013.01);
(Continued)

(58) Field of Classification Search
CPC ..... D21J 3/00; D21J 7/00; B65D 43/0222; B65D 2543/00092; B65D 2543/00268;
(Continued)

(56) References Cited

U.S. PATENT DOCUMENTS 7,370,788 B1 * 5/2008 Otani ..... B65D 1/0215 229/407
2004/0241274 A1 * 12/2004 Odajima ..... D21J 7/00 425/389

(Continued)

FOREIGN PATENT DOCUMENTS

EP 3 133 028 A1 2/2017
JP 2005-205877 A 8/2005

(Continued)

OTHER PUBLICATIONS

International Searching Authority, "International Search Report," issued in connection with International Patent Application No. PCT/JP2020/018666, dated Jun. 23, 2020, 5 pages.

(Continued)

*Primary Examiner* — Jose A Fortuna
(74) *Attorney, Agent, or Firm* — Foley & Lardner LLP

(57) ABSTRACT

A method of producing a lid including a top plate and a side wall extending downward from a periphery of the top plate, using molds, the molds including a papermaking mold and a drying mold. The top plate is provided with an abutting part abutting against an edge of an opening of a container, while an undercut part to be fitted to a lower part of the edge is formed on the side wall so as to be located below the abutting part. The papermaking mold is provided with suction holes at a level corresponding to a level of the undercut part formed on an inner surface of the side wall. The side wall is suctioned using the suction holes when a molded article is at least in one of several states to form the undercut part in a convex shape on the inner surface of the side wall.

5 Claims, 11 Drawing Sheets

(52) U.S. Cl.
CPC ..... *B65D 2543/00268* (2013.01); *B65D 2543/00537* (2013.01); *B65D 2543/00731* (2013.01)

(58) Field of Classification Search
CPC ..... B65D 2543/00537; B65D 2543/00731; B65D 43/08; B31D 5/02
See application file for complete search history.

(56) References Cited

U.S. PATENT DOCUMENTS

| | | | | |
|---|---|---|---|---|
| 2011/0227244 | A1* | 9/2011 | Brown | B65D 43/0212 264/101 |
| 2014/0048552 | A1* | 2/2014 | Wang | B65D 43/02 220/780 |
| 2018/0086511 | A1 | 3/2018 | Lin | |
| 2021/0054569 | A1* | 2/2021 | Uehara | D21H 17/34 |
| 2022/0064869 | A1* | 3/2022 | Yamazaki | B31D 5/02 |

FOREIGN PATENT DOCUMENTS

| | | | | | |
|---|---|---|---|---|---|
| JP | 2009-292528 | A | | 12/2009 | |
| JP | 4588236 | B2 | | 11/2010 | |
| JP | 2013-129921 | A | | 7/2013 | |
| JP | 2013142000 | A | * | 7/2013 | |
| JP | 3190372 | U | | 5/2014 | |
| JP | 2020185749 | A | * | 11/2020 | B65D 43/0222 |
| JP | 2020186042 | A | * | 11/2020 | B29C 33/44 |
| JP | 2021172356 | A | * | 11/2021 | |
| WO | WO-2010/064899 | A1 | | 6/2010 | |

OTHER PUBLICATIONS

International Searching Authority, "Written Opinion," issued in connection with International Patent Application No. PCT/JP2020/018666, dated Jun. 23, 2020, 3 pages.
Extended European Search Report issued in corresponding European Patent Application No. 20806687.8 dated Jun. 13, 2022.

* cited by examiner

LID, METHOD OF PRODUCING LID, AND MOLDS FOR FORMING MOLDED PULP

CROSS-REFERENCE TO RELATED PATENT APPLICATIONS

This application is a continuation application filed under 35 U.S.C. § 111(a) claiming the benefit under 35 U.S.C. §§ 120 and 365(c) of International Patent Application No. PCT/JP2020/018666, filed on May 8, 2020, which is based upon and claims the benefit of priority to Japanese Patent Application No. 2019-092963, filed on May 16, 2019; the disclosures of which are incorporated herein by reference in their entireties.

TECHNICAL FIELD

The present invention relates to pulp molded lids fitted to containers, methods of producing lids, and molds for forming a molded pulp.

BACKGROUND

Truncated cone-shaped paper containers can be produced at high speed and at low cost, and are easy to dispose of because of being made of paper. Furthermore, they have great advantages in that they can be easily filled with contents, can be used for both cold food and hot food due to having low thermal conductivity, and other advantages. To keep contents warm for a long time using paper containers, the contents are preferred to be provided with covers. For example, JP 4588236 B proposes a cup lid to be mounted on a cup having an open top whose outer periphery is provided with a curled part, characterized in that the cup lid includes a panel surface that covers a cup opening plane, a curled part fitting groove that is formed in an edgeless manner along the outer periphery of the panel surface so as to protrude from the outer periphery and have an upper portion having substantially an arc-shaped cross section, a lid engagement part that has a flange shape and is formed to protrude outward at an outer position below the curled part fitting groove, and a stacked rib part that is formed to protrude upward from the panel surface. In the cup lid, the curled part fitting groove has a curled part fitting groove entrance having a width smaller than the maximum width of the curled part fitting groove; the surface extending from the curled part fitting groove entrance to the panel surface forms a fitting groove introduction part that is flared downward in a bell shape, together with the surface extending to the lid engagement part; the fitting groove introduction part is formed to have a centering function when the lid is mounted to a cup; and the fitting groove introduction part includes an inner flared surface, a downwardly-extended wall part having a vertical surface extended downward from the curled fitting groove entrance, and an outer flared surface extending from the lower end of the downwardly-extended wall part to the lid engagement part.

The cup lid proposed by this patent literature is a generally used easy-to-fit cup lid formed by shaping a plastic sheet. However, cup lids made of plastic cannot be discarded with paper cups. In this regard, it is convenient to cover the openings of cups with lids made of the same pulp as that used for the paper cups because the lids can be discarded with the cups if some contents remain in the cups. However, pulp molded lids lack flexibility. Therefore, when such a cup lid is molded using a pulp and detached from the mold, and if the molded cup lid has an undercut such as a fitting groove as mentioned above, the cup lid cannot be deformed and loosened making use of flexibility that would have been imparted by plastic, and the undercut may be easily damaged. Therefore, there has been an issue that formation processing has to be divided into multiple steps including a step of forming a lid without forming an undercut, and a subsequent step of forming a fitting part through secondary processing.

SUMMARY OF THE INVENTION

Technical Problem

The present invention aims to achieve a production method in which a lid that can be fitted to a container is molded using a pulp, and the lid can be stably released from the molds for forming a molded pulp without damaging the shape of an undercut to be fitted to the opening of the container.

Solution to Problem

As an aspect, the present invention relates to a method of producing a lid. The method of producing a lid produces a lid that includes a top plate including an abutting part, and a side wall including an undercut part provided below the abutting part and extending downward from a periphery of the top plate, using molds for forming a molded pulp, the molds including a papermaking mold and a drying mold. In the production method, the papermaking mold for forming a lid is provided with one or more suction holes at a level corresponding to a level of the undercut part to be formed on an inner surface of the side wall. The production method includes forming the undercut part in a convex shape on an inner surface of the side wall by suctioning the side wall using the suction holes when a molded article of the lid is at least in any one of a state that is before being heated and dried, a state that is under heating and drying, and a state that is immediately before being released.

The production method further includes blowing air outward from the suction holes after heating and drying the lid to loosen the undercut part formed on the inner surface of the side wall from the papermaking mold, and detaching a molded article of the lid.

As another aspect, the present invention relates to molds for forming a molded pulp. The molds for forming a molded pulp are used for producing a lid which includes a top plate including an abutting part, and a side wall including an undercut part provided below the abutting part and extending downward from a periphery of the top plate. The molds for forming a molded pulp include a papermaking mold and a drying mold. A papermaking mold of the molds for forming a molded pulp is provided with one or more suction holes at a level corresponding to a level of the undercut part to be formed on an inner surface of the side wall. In this lower mold for forming a molded pulp, the side wall can be suctioned using the suction holes when a molded article of the lid is at least in any one of a state that is before being heated and dried, a state that is under heating and drying, and a state that is immediately before being released.

In the mold for forming a molded pulp, the suction holes may each have a diameter of 1 mm to 5 mm and a depth of 0.2 mm to 1 mm. Bottoms of the suction holes may be formed of a sintered material containing inter-connected pores. The suction holes may be discontinuously or partially provided on a periphery facing the side wall of the lid.

As still another aspect, the present invention relates to a lid. The lid which is formed of a molded pulp includes a top plate and a side wall extending downward from the top plate, the lid being fittable to an upper edge of an opening of a container. The lid is discontinuously or partially provided with an undercut part in a convex shape along an inner periphery of the side wall. As still another aspect, the lid is continuously provided with an undercut part in a convex shape along an inner periphery of the side wall.

Advantageous Effects of the Invention

In the method of producing a lid of the present invention, an undercut part in a convex shape is formed on an inner surface of a side wall by providing suction holes and suctioning air through the suction and vent holes when a pulp molded article is at least in any one of a state that is before being heated and dried, a state that is under heating and drying, and a state that is immediately before being released. By the time the lid is released from the molds, the lid is sufficiently dried and can easily retain its shape. Accordingly, using the suction holes, the lid can be easily detached without damaging the undercut part. Thus, lids can bestably produced using a pair of molds at low cost and with high productivity without dividing the processing into multiple steps.

DETAILED DESCRIPTION

Embodiments of the present invention will be described below with reference to the drawings. In the following description of the drawings to be referred, components or functions identical with or similar to each other are given the same or similar reference signs, unless there is a reason not to. It should be noted that the drawings are only schematically illustrated, and thus the relationship between thickness and two-dimensional size of the components, and the thickness ratio between the layers, are not to scale. Therefore, specific thicknesses and dimensions should be understood in view of the following description. As a matter of course, dimensional relationships or ratios may be different between the drawings.)

Further, the embodiments described below are merely examples of configurations for embodying the technical idea of the present invention. The technical idea of the present invention does not limit the materials, shapes, structures, arrangements, and the like of the components to those described below. The technical idea of the present invention can be modified variously within the technical scope defined by the claims. The present invention is not limited to the following embodiments within the scope not departing from the spirit of the present invention. For the sake of clarity, the drawings may be illustrated in an exaggerated manner as appropriate.

In any group of successive numerical value ranges described in the present specification, the upper limit value or lower limit value of one numerical value range may be replaced with the upper limit value or lower limit value of another numerical value range. In the numerical value ranges described in the present specification, the upper limit values or lower limit values of the numerical value ranges may be replaced with values shown in examples. The configuration according to a certain embodiment may be applied to other embodiments.

Figure 1A:
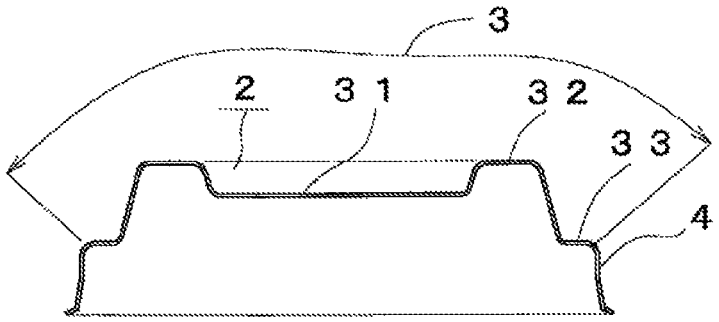
FIG. 1A is a longitudinal cross-sectional view illustrating a wet molded article according to an embodiment of the present invention.
Figure 1B:
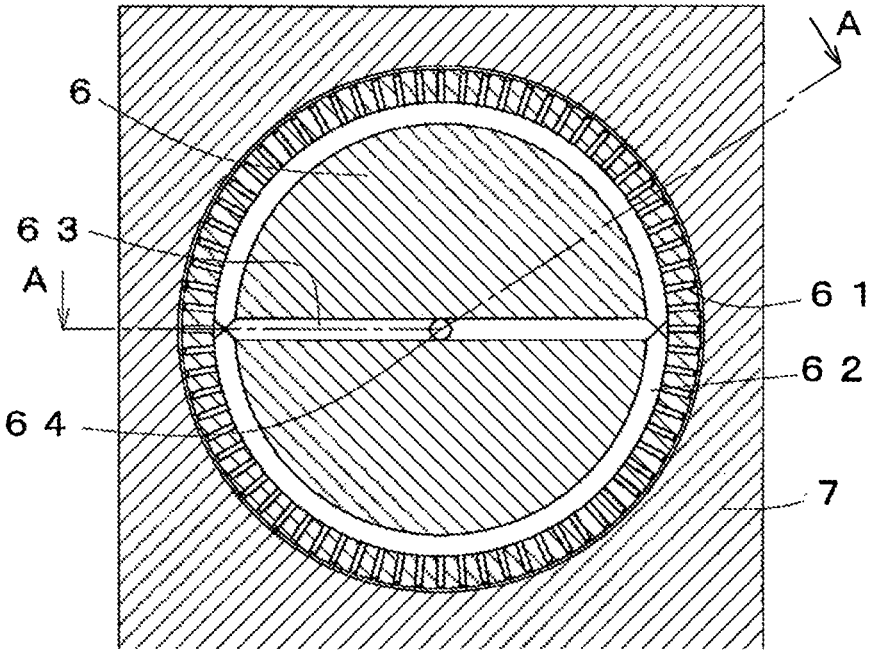
FIG. 1B is a transverse cross-sectional view illustrating molds for forming a molded pulp, used for forming the wet molded article shown in FIG. 1A for a lid.
Figure 1C:
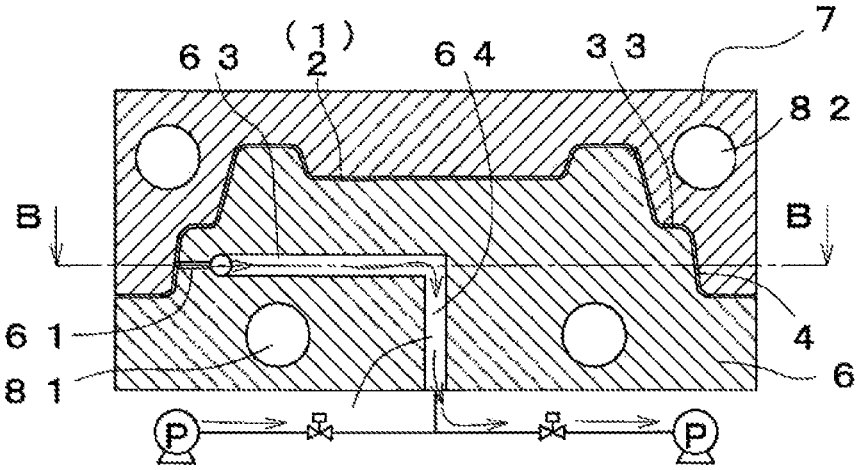
FIG. 1C is a longitudinal cross-sectional view illustrating the molds for forming a molded pulp shown in FIG. 1B.

With reference to the drawings, a method of producing a lid according to an embodiment of the present invention will be described in detail. FIG. 1A is a longitudinal cross-sectional view illustrating a wet molded article according to an embodiment of the present invention. FIGS. 1B and 1C are transverse and longitudinal cross-sectional views each illustrating molds for forming a molded pulp, used for pulp molding the wet molded article shown in FIG. 1A.

FIG. 1A shows a wet molded article 2 (lid intermediate) which is obtained by dissolving plant fibers, placing a papermaking mold 6 (core) in the pulp slurry pool, suctioning the pulp for adhesion over the surface of the papermaking mold 6 (core) using a papermaking process, and forming the pulp into the shape of the mold. Instead of being placed in a generally used drying furnace, the wet molded article 2 on the papermaking mold 6 (core) is covered with the drying mold 7 (cavity) and the drying and papermaking molds 7 and 6 are heated to a high temperature using cartridge heaters 81 and 82 provided in the molds or using heated steam, or other means. Thus, water contained in the wet molded article 2 is evaporated and a lid 1 that is a pulp molded article can be obtained.

Pulp molded articles, in which fibers are hydrogen bonded and three-dimensionally entangled, do not have high elasticity as plastic molded articles do. However, pulp molded articles serve as packaging materials having good breathability, water retentiveness, and shape flexibility, and having high shape retention performance and high impact resistance. Therefore, if molded articles should include undercuts, it is necessary to use a method in which the articles are suctioned and provided with undercuts in a state not yet heated and dried or at least in a semi-dry state that is not a completely dried state which would prevent reshaping. Accordingly, the wet molded article 2 is formed into a 2.5-dimensional shape in which only information in the height direction is added to the XY plane. Specifically, the molded articles can be loosened in the vertical direction with shapes including no undercuts, or no reverse slopes, and therefore they can be detached without resistance.

As shown in FIG. 1A, the wet molded article 2 used in the present embodiment includes a top plate 3 and a side wall 4 extending downward from the periphery of the top plate 3. In the vicinity of the periphery of the top plate 3 adjacent to the side wall 4, there is formed an abutting part 33 which abuts against an upper edge 511 of an opening 51 of a container 5 (see FIG. 3). The top plate 3 is provided with a recessed part 31 that is recessed inward at the center thereof The recessed part 31 may be provided with a hole into which a straw or the like can be inserted. If the contents or liquid, which is condensed vapor or the like of the contents, become attached to the inner surface of the top plate 3, they can be easily returned to the inside of the container 5 due to the presence of the recessed part 31. A high bank part 32 is provided surrounding the center portion to define the recessed part 31 and secure a level for the recessed part 31 to be reliably distanced from the contents. It should be noted that the bank part 32 is formed along the circumference.

FIGS. 1B and 1C each show the papermaking mold 6 (core) and the drying mold 7 (cavity) for forming convexities to be fitted to the edge 511 of the container 5, by suctioning the inner surface of the side wall 4 in a state in which the wet molded article 2 is not yet dried. FIG. 1B is a transverse cross-sectional view taken along the line B-B of FIG. 1C, and FIG. 1C is a longitudinal cross-sectional view taken along the line A-A of FIG. 1B. The papermaking mold 6 (core) is provided with suction holes 61 at substantially a constant level corresponding to a predetermined level of the inner surface of the side wall 4. The suction holes 61 are formed being circumferentially arranged facing the inner surface of the side wall 4. On the inside of the circumferential arrangement of the suction holes 61, an annular pipe 62 is formed which is connected to a vacuum pump or a suction pump provided on the outside of the molds via suction pipes 63 and 64 to suction the side wall 4. The suction holes 61 are provided at a level corresponding to a level of an undercut part 41 (see FIG. 3) to be formed on an inner surface of the side wall 4.

The suction holes 61 for forming the undercut part 41 in a convex shape have inner diameters in the range of 1 mm to 5 mm. If the inner diameters of the suction holes 61 are less than 1 mm, the pulp fibers may clog the suction holes and sufficient suction cannot be performed, making it difficult to appropriately form undercuts. If the inner diameters of the suction holes 61 are 5 mm or more, the undercut part 41 may have an excessively large height and this may raise an issue that the lid is difficult to detach from the mold. Therefore, the inner diameters of the suction holes 61 are preferred to be in the range of 1 mm to 5 mm.

If the undercut part 41 in a convex shape has an excessively large height, the lid cannot be loosened from the mold. Accordingly, the height of the undercut part 41 is required to be in the range of 0.2 mm to 1 mm. Usually, no matter how deeply the suction holes 61 may be formed, the height of the undercut part 41 can be reduced to be in the range of 0.2 mm to 1 mm as long as the inner diameters of the suction holes 61 are in the range of 1 mm to 5 mm.

The depth of the suction holes 61 may be adjusted to control the height of the convex undercut part 41. For example, in the mold, bottoms formed of a sintered material containing inter-connected pores may be provided at some depth within the suction holes 61 to reliably limit the height. The sintered material may be formed by placing a ceramic or metal powder, or the like, in a mold, passing direct current therethrough, for example, under a high temperature condition that is slightly lower than the melting point of the material, and fusing only contacting portions of the grains to form inter-connected pores. Such a sintered material has high heat resistance, high hardness, and high breathability, allows gas or liquids such as water to pass therethrough, but does not allow solids such as fibers and highly viscous substances to pass therethrough. Accordingly, if such a material is used for the molds for forming a molded pulp, which are used in the present embodiment, a predetermined depth can be stably achieved.

When the side wall 4 of the wet molded article 2 in a semi-dry state is suctioned using the suction holes 61, the article is deformed and suctioned into the suction holes 61 to form an undercut part 41 in a convex shape. The wet molded article 2 is dried in the state in which the convex undercut part 41 is formed.

Figure 2A:
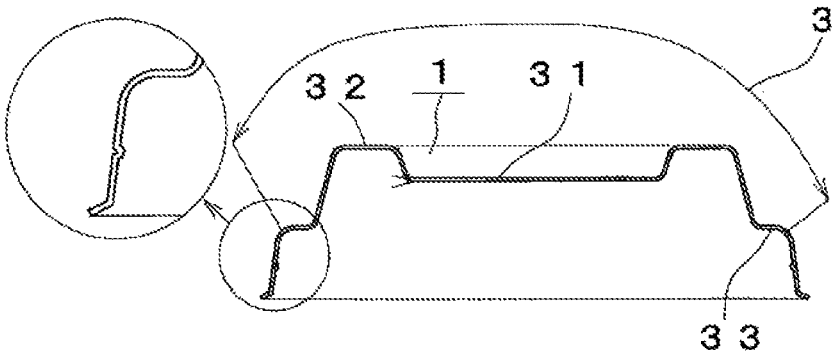
FIG. 2A is a longitudinal cross-sectional view illustrating a lid according to an embodiment of the present invention.
Figure 3:
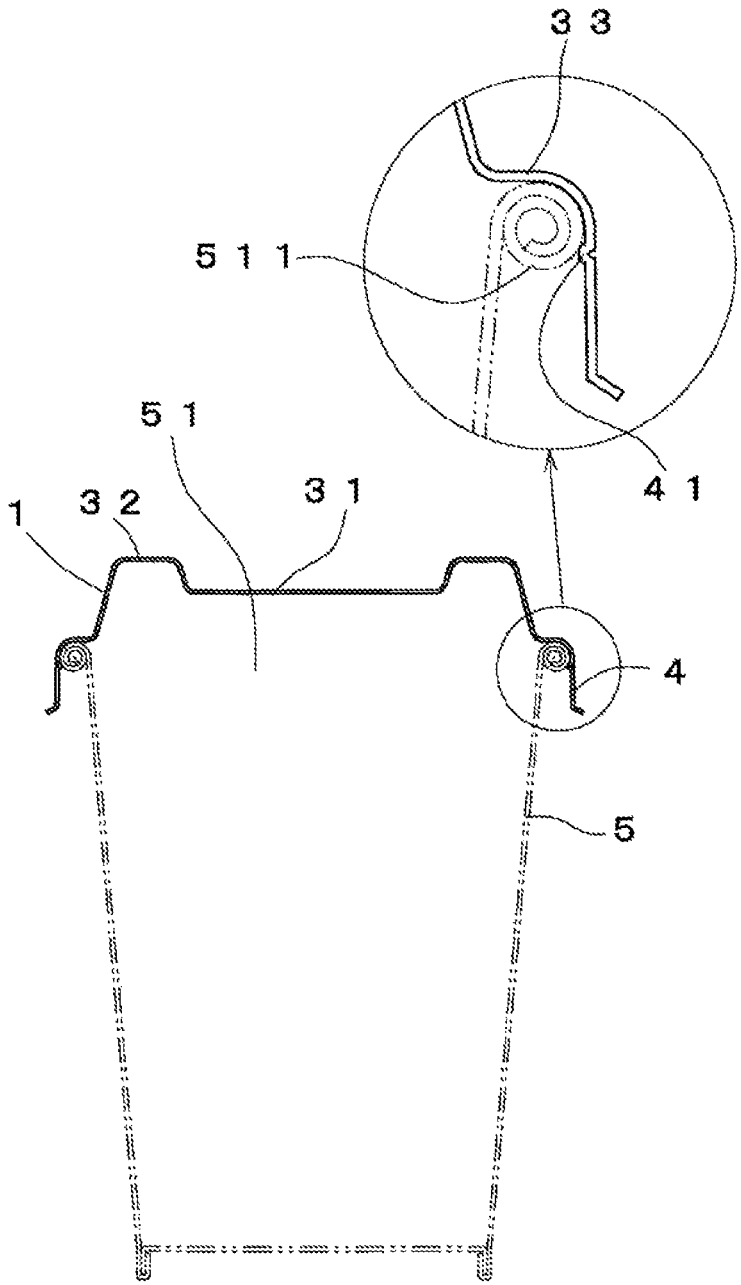
FIG. 3 is a longitudinal cross-sectional view illustrating a state in which a lid according to an embodiment of the present invention is fitted to a container.

FIG. 2A shows a lid 1 which has been dried after forming a convex undercut part 41 on the inner surface of the side wall 4. As shown in FIG. 3, the convex undercut part 41 is used when the lid 1 is fitted to the container 5. As shown in the longitudinal cross-sectional view of FIG. 3, the side wall 4 of the lid 1 is fitted to the opening 51 of the container 5. The abutting part 33 abuts against the upper end of the opening 51 of the container 5, while the convex undercut part 41 formed on the inner surface of the side wall 4 of the lid 1 engages with a lower end of the edge 511 at the upper end of the opening 51. Thus, the lid 1 fits the periphery of the opening 51 of the container 5 to cover the opening 51 and protect the contents.

Figure 5A:
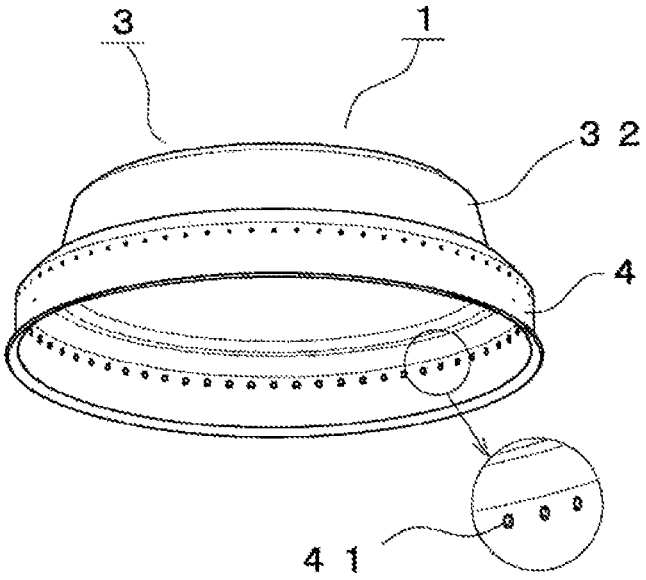
FIG. 5A is a perspective view illustrating a lid according to an embodiment of the present invention.

The molds used for forming a molded pulp of a first embodiment shown in FIG. 1B include the suction holes 61 for forming an undercut part 41 as a fitting configuration as shown in the perspective view of FIG. 5A. Specifically, an undercut part 41 in the form of dots or circular convexities is discontinuously (or partially) and circumferentially formed along the inner periphery of the side wall 4 using the suction holes 61. As in the present embodiment, the lid 1 includes unprocessed portions where undercuts are not formed and processed portions where undercuts are formed. Therefore, the side wall 4 of the lid 1 can be easily twisted via the unprocessed portions for easy deformation of the lid 1. This is advantageous in that the lid 1 can be easily fitted to or detached from the opening 51 of the container 5 without requiring a large force.

Figure 4A:
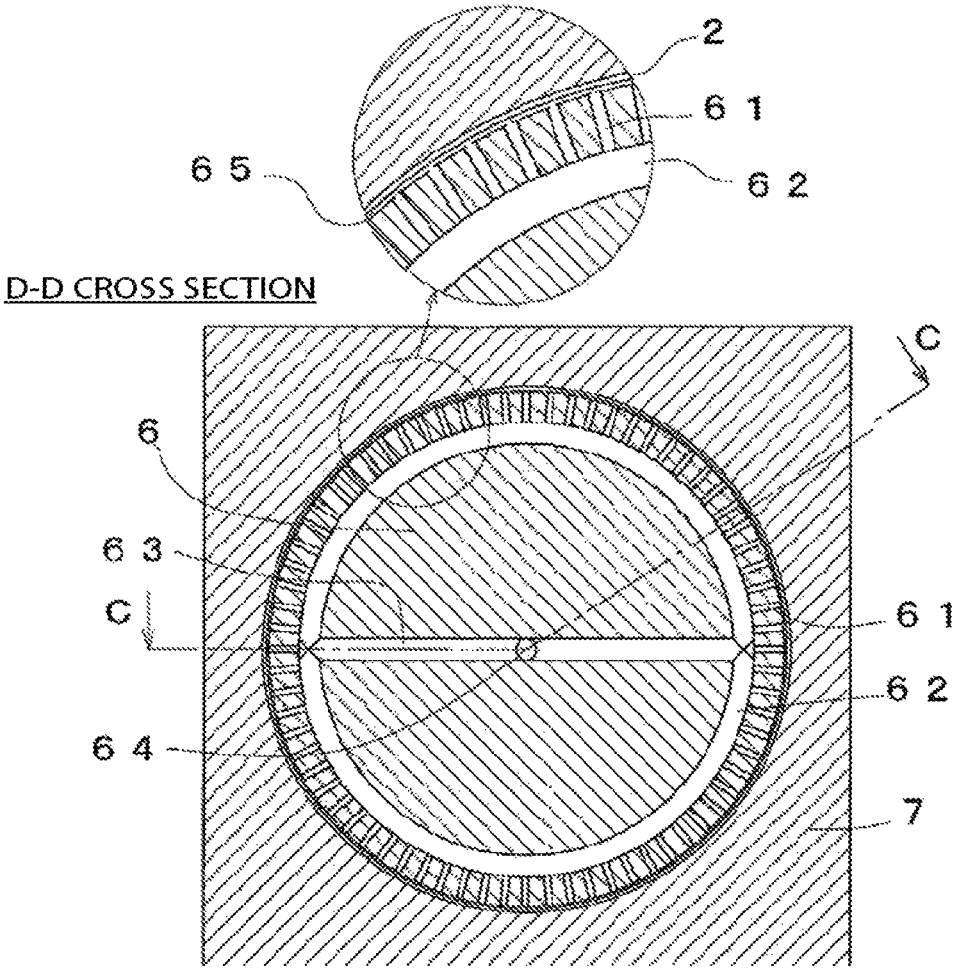
FIG. 4A is a transverse cross-sectional view illustrating a second embodiment of the molds for forming a molded pulp, used for forming the lid shown in FIG. 1A.
Figure 4B:
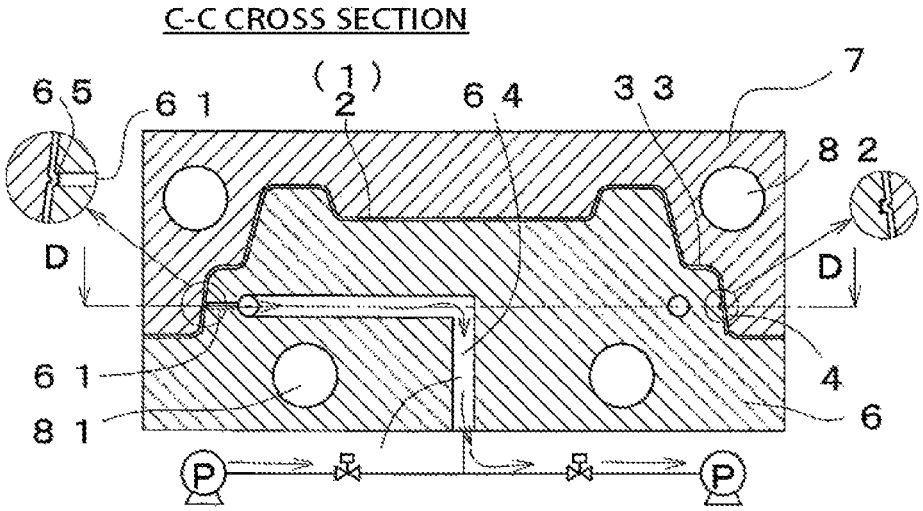
FIG. 4B is a longitudinal cross-sectional view illustrating the molds for forming a molded pulp shown in FIG. 4A.
Figure 5B:
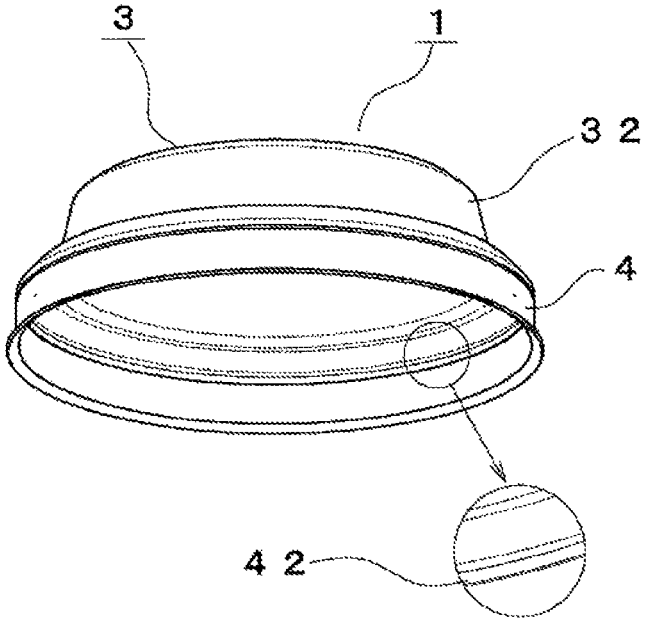
FIG. 5B is a perspective view illustrating a lid according to another embodiment of the present invention.

FIGS. 4A and 4B each show molds for forming a molded pulp related to a second embodiment. As shown, the molds for forming a molded pulp may include a continuous suction part 65 so that the lid 1 is provided with a continuous convex configuration for the undercut part 41, as shown in the perspective view of FIG. 5B, along the inner periphery of the side wall 4. As in the embodiment shown in FIG. 5B, a continuously formed undercut part is advantageous in that stronger fitting can be achieved and the contents are unlikely to leak if the container 5 is tilted.

Figure 2B:
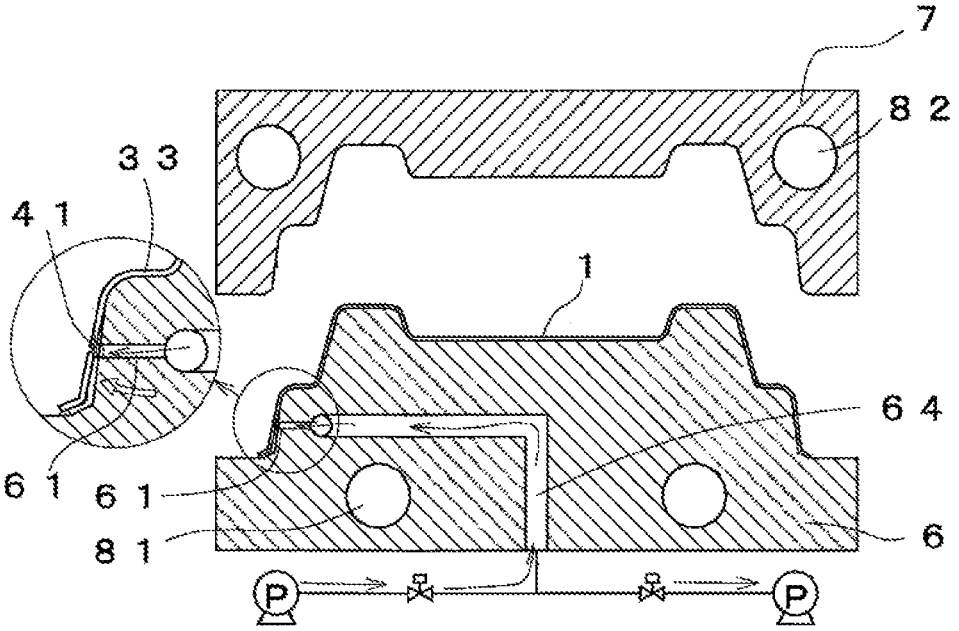
FIG. 2B is a longitudinal sectional view illustrating a process of detaching a lid from molds after pulp molding and drying.

FIG. 2B is a longitudinal cross-sectional view illustrating a process of detaching a lid 1 after forming an undercut part 41 in a convex shape followed by drying. First, the drying mold 7 (cavity) is separated from the papermaking mold 6 (core) to expose the outer side of the lid 1. The lid 1 obtained as a result of heating the molds to a high temperature and evaporating moisture from the wet molded article 2 followed by drying is unlikely to be deformed and is enhanced in hardness. Then, the piping valve is switched to a compression pump to send compressed air or the like therefrom and blow it from the suction holes 61, so that the convex undercut part 41 formed being fitted and suctioned into the suction holes 61 is loosened from the suction holes 61.

Figure 2C:
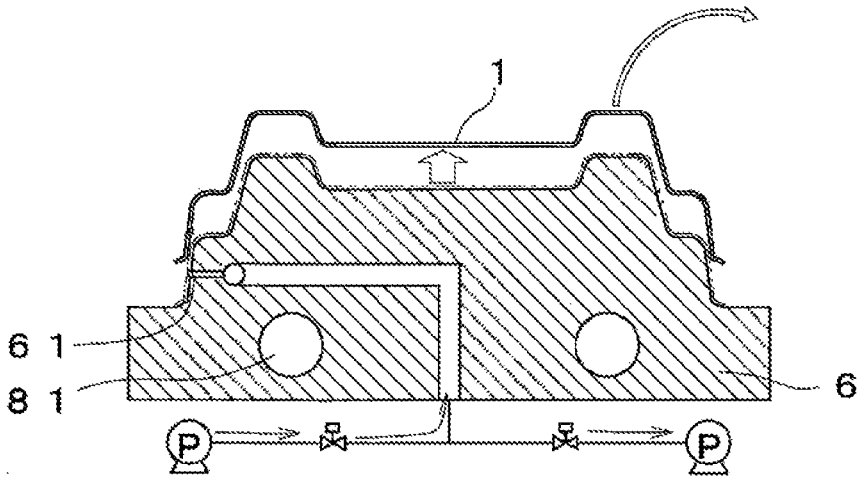
FIG. 2C is a longitudinal cross-sectional view illustrating a process of detaching the lid from the molds subsequent to the process shown in FIG. 2B.

Thus, while the undercut part 41 is loosened, the side wall 4 is temporarily expanded outward as shown in FIG. 2C, and the blown compressed air blows into the lid 1 to release it from the papermaking mold 6 (core). As a matter of course, the lid 1 may be detached while it is suctioned using a robot. Alternatively, the molds may be turned upside down so that the lid 1 falls from the papermaking mold 6 (core) due to gravity.

The method of producing a lid according to the present embodiment has been described so far. Specifically, the suction holes 61 are provided on the inside of the side wall 4, and air is suctioned through the suction holes 61 during heating and drying in the latter half of the pulp molding to form a convex undercut part 41 on the inner surface of the side wall 4. By the time the lid 1 is released from the molds for forming a molded pulp, the lid 1 is sufficiently dried and can easily retain its shape. Accordingly, the lid 1 can be detached by only having air blow into it, without damaging the undercut part 41 and without the need of incorporating a complicated mechanism, such as a slider, into the molds. Thus, lids can be stably produced using a pair of simple molds at low cost and with high productivity without dividing the processing into multiple steps. It should be noted that the side wall 4 may be suctioned using the suction holes 61 in a state not yet heated and dried in the first half of the pulp molding, or in a state immediately before release of the lid 1.

Furthermore, the lid 1 related to the present embodiment is produced using a papermaking process from a pulp in which the fibers are three-dimensionally entangled. Therefore, the lid 1 is imparted with good breathability, water retentivity, and shape flexibility, and will not pollute the atmosphere with ash or gas after burning. Thus, the lid 1 can be discarded together with the container it fitted to if the container is made of paper. In addition, the lid 1 does not require the use of harmful chemicals for the large amount of water used during molding, and therefore imposes almost no burden on the natural environment and can be easily reused as a resource. Accordingly, the lid 1 can be utilized without losing the advantages of environmentally friendly pulp molding until it is finally converted to soil.

INDUSTRIAL APPLICABILITY

The present invention can be applied to lids, methods of producing lids, and molds for forming a molded pulp.

REFERENCE SIGNS LIST

1 . . . Lid; 2 . . . Wet molded article (lid intermediate); 3 . . . Top plate; 31 . . . Recessed part; 32 . . . Bank part; 33 . . . Abutting part; 4 . . . Side wall; 41 . . . Undercut part; 5 . . . Container; 51 . . . Opening; 511 . . . Edge; 6 . . . Papermaking mold (core); 61 . . . Suction hole; 62 . . . Pipe; 63, 64 . . . Suction pipe; 65 . . . Suction part; 7 . . . Drying mold (cavity); 81, 82 . . . Cartridge heater.

What is claimed is:

1. A method of producing a lid, the lid comprising a top plate including an abutting part, and a side wall including an undercut part provided below the abutting part and extending downward from a periphery of the top plate, the lid being produced using molds for forming a molded pulp, the molds including a papermaking mold and a drying mold, wherein the papermaking mold for forming a lid is provided with one or more suction holes at a level corresponding to a level of the undercut part to be formed on an inner surface of the side wall, the method comprising forming the undercut part in a convex shape on an inner surface of the side wall by suctioning the side wall using the suction holes;

heating and drying a molded article of the lid; and releasing the lid from the molds; wherein said forming is performed when the molded article of the lid is in a state that is before said heating and drying, a state that is under said heating and drying, and a state that is immediately before said releasing.

2. The method of producing a lid of claim 1, further comprising blowing air outward from the suction holes after said heating and drying, to loosen the undercut part formed on the inner surface of the side wall from the papermaking mold for said releasing.

3. The method for producing a lid of claim 1, wherein the suction holes each have a diameter of 1 mm to 5 mm and a depth of 0.2 mm to 1 mm.

4. The method for producing a lid of claim 1, wherein bottoms of the suction holes are formed of a sintered material containing inter-connected pores.

5. The method for producing a lid of claim 1, wherein the suction holes are discontinuously or partially provided on a periphery facing the side wall of the lid.

* * * * *